United States Patent [19]

Morris

[11] 4,223,794

[45] Sep. 23, 1980

[54] PUSH BUTTON SAFETY CAP FOR GLASS BOTTLES

[76] Inventor: Glenn H. Morris, 4203 Highwood Dr., Chattanooga, Tenn. 37415

[21] Appl. No.: 74,780

[22] Filed: Sep. 12, 1979

[51] Int. Cl.[3] ..... B65D 55/02

[52] U.S. Cl. ..... 215/220

[58] Field of Search ..... 215/219, 220; 220/288

[56] References Cited

U.S. PATENT DOCUMENTS

| | | | |
|---|---|---|---|
| 3,520,435 | 7/1970 | McIntosh | 215/220 |
| 3,710,970 | 1/1973 | Elfline | 215/219 X |
| 3,756,444 | 9/1973 | McIntosh | 215/220 |

*Primary Examiner*—George T. Hall

*Attorney, Agent, or Firm*—Brady, O'Boyle & Gates

[57] ABSTRACT

A safety cap arrangement for containers of materials which are dangerous to children is provided wherein a user will detect by merely looking at the cap whether it is in a safe or non-safe condition. When the cap is being applied to a container, its push button operator will rise automatically to a condition indicating that the cap is safe or child-proof. The safety cap can be operated without discomfort to the fingers of the user, is convenient, simple in construction and economical. A visual indicator enables the user to know when the push button operator on the outer cap is positioned to engage driving elements of the inner cap.

10 Claims, 11 Drawing Figures

FIG. 1
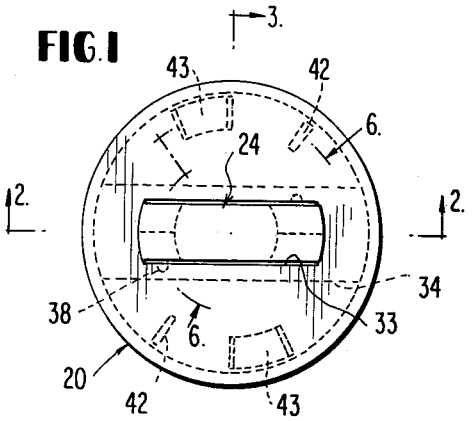
FIG. 2
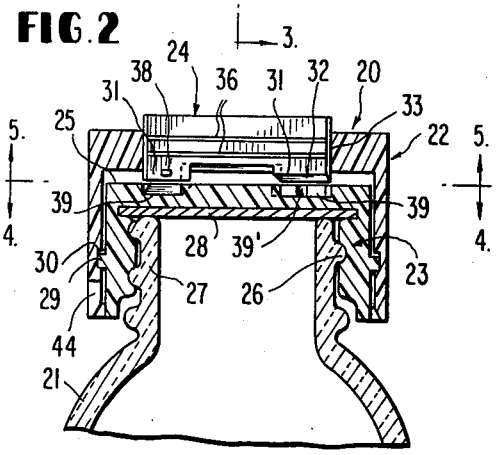
FIG. 3
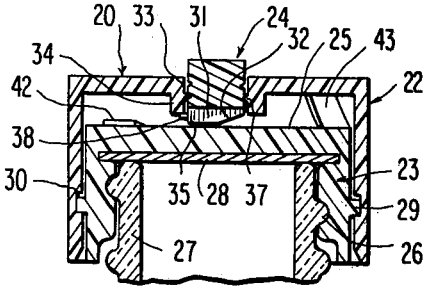
FIG. 4
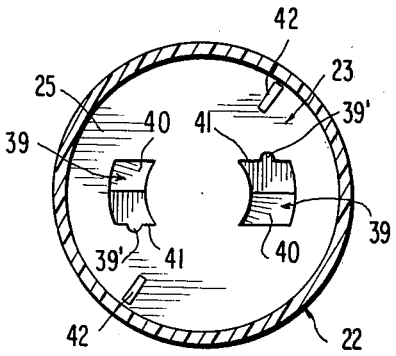
FIG. 6
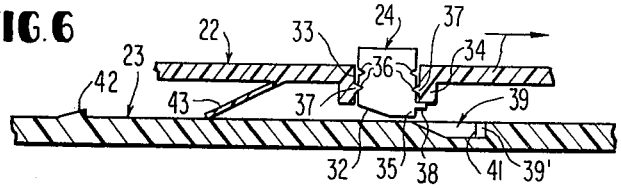
FIG. 7
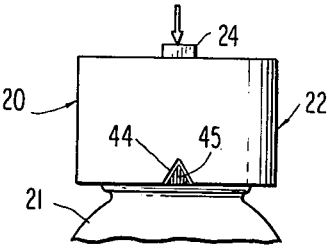
FIG. 8
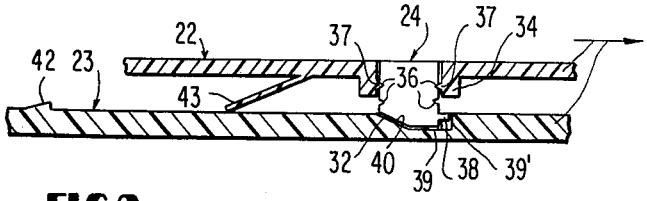
FIG. 9
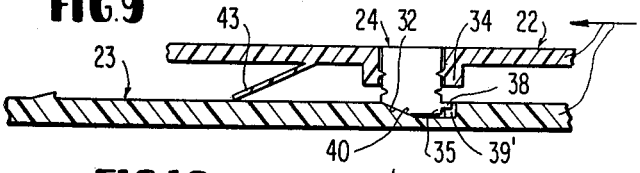
FIG. 10
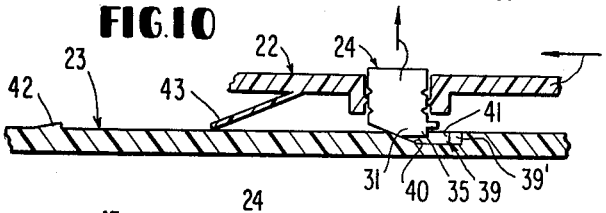
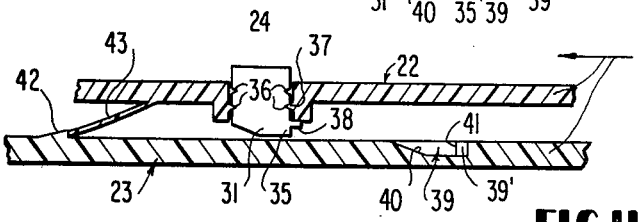
FIG. 11
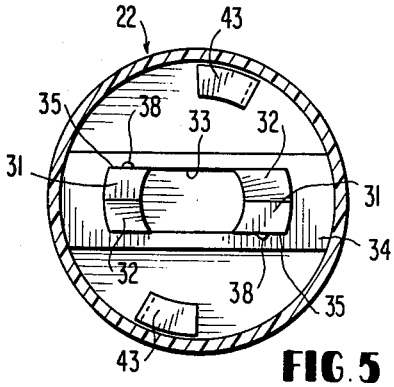
FIG. 5

PUSH BUTTON SAFETY CAP FOR GLASS BOTTLES

BACKGROUND OF THE INVENTION

The objective of the present invention is to provide an improved safety cap for containers of medicines and poisons, particularly glass bottles. The invention seeks to provide a cap arrangement which is practical and economical and convenient to operate without discomfort to the fingers, in contrast to some safety caps now on the market.

An important objective is to provide a safety cap which will indicate merely by visual inspection whether the cap is in a safe (child-proof) or unsafe condition; and to provide such a cap including a push button operator which will return automatically to a safe indicating position whenever the cap is re-applied to a bottle or container.

In accordance with another object, the push button operator has positioning detent means and camming means which coact with camming means on the interior cap section to cause the push button operator to rise automatically to the safe or child-proof indicating position when the cap is being tightened.

In accordance with a further feature, a convenient indicator is provided on the safety cap to enable an operator, when removing the cap, to properly position the push button operator in relation to coacting clutch or driving means on the inner cap section so that the push button operator can then be depressed into engagement with the driving means.

Other features and advantages of the invention will become apparent during the course of the following detailed description.

BRIEF DESCRIPTION OF THE DRAWINGS

FIG. 1 is a plan view of a safety cap for containers according to the invention.

FIG. 2 is a central vertical section taken on line 2—2 of FIG. 1.

FIG. 3 is a similar section taken on line 3—3 of FIG. 1.

FIG. 4 is a horizontal section taken on line 4—4 of FIG. 2.

FIG. 5 is a similar section taken on line 5—5 of FIG. 2.

FIG. 6 is an expanded cross section taken on line 6—6 of FIG. 1.

FIG. 7 is a side elevation of the safety cap showing indicator means.

FIGS. 8 through 11 are views similar to FIG. 6 depicting the operation of the safety cap.

DETAILED DESCRIPTION

Referring to the drawings in detail wherein like numerals designate like parts, a safety or child-proof cap assembly 20 particularly useful on glass bottles of the type indicated at 21 comprises an outer cap section 22, an inner cap section 23 and a push button operator 24 as main components. These components may be formed of suitable plastics commonly used for container closures.

The inner cap section 23 is cylindrical and has a flat top face 25. It is internally screw-threaded as shown at 26 to engage with screw-threads molded on the exterior of the neck 27 of bottle 21. A suitable seal 28 is provided between the top wall of cap section 23 and the bottle neck end face.

The outer cap section 22 is also cylindrical and has a flat top face and engages telescopically over the inner cap section 23 and has a permanent free rotational connection with the inner cap section by virtue of interfitting annular tongue and groove elements 29 and 30 on the two cap sections.

The elongated bar-like push button operator 24 includes at its opposite ends two depending drive teeth 31 or projections having oppositely sloping or beveled bottom face portions 32 serving as cams, in a manner to be described. The push button operator 24 is received movably in a slot 33 formed through the top wall of outer cap section 22 adjacent to a boss 34 formed on the underside of such top wall. The two drive teeth 31 have square shoulders 35 at their sides away from the beveled face portions 32 and the bottoms of the teeth 31 are flat and parallel to the top face of the push button operator and the flat top face 25, FIG. 3. The body portion of the push button operator 24 is provided on opposite sides thereof with spaced parallel detent grooves 36 adapted to cooperate with projecting detent ribs 37, one each on each side wall of the slot 33. A single retainer tab 38 is formed on each side of the push button operator 24 and engages below the boss 34 to prevent complete separation of the push button operator from the outer cap section 22.

The inner cap section 23 is provided in its top wall with a spaced pair of recesses 39 adapted to receive and cooperate with the drive teeth 31. The two recesses 39 have inclined bottom wall portions 40 to be engaged by the beveled tooth faces 32 and square corners 41 opposite the portions 40 to be engaged and driven by the square shoulders 35 at proper times. The recesses 39 have flat bottom walls which are parallel to the bottom faces of the driving teeth 31, and small end recesses 39' to accommodate the retainer tabs 38.

An important feature of the invention resides in the provision of a single pair of diametrically opposed ratchet teeth 42 on the top face 25 of inner cap section 23. In the final tightening of the safety cap, to be further described, these ratchet teeth 43 are engaged by spring pawls 43 attached dependingly to the top wall outer cap section 22. The location of the two teeth 42 relative to the driving pawls 43 when the push button operator 24 is depressed is somewhat critical because it is required that the push button operator be automatically returned to its elevated safe indicating position before driving engagement of the pawls 43 with the ratchet teeth 42.

To insure proper registration of drive teeth 31 with the two recesses 39 in the releasing of the safety cap, an indicator notch 44 is formed in the skirt of outer cap section 22 which becomes aligned with a colored indicator spot 45 on the skirt of the inner cap section 23 when the drive teeth 31 are properly aligned with recesses 39.

The mode of operation of the safety cap can best be understood by reference to FIGS. 6 through 11. FIGS. 6 through 8 illustrate the operation of releasing the safety cap from the container while FIGS. 9 through 11 show the operation of tightening the cap.

Referring to FIGS. 6 through 8, to remove the safety cap assembly 20 from the container, the outer cap section 22 is turned counterclockwise, preferably, as indicated by the directional arrow in FIG. 6, while the inner cap section 23 remains stationary. This rotation of the outer cap section is continued until the indicator notch 44 registers with the indicator marking 45 as shown in FIG. 7. At this time, the push button operator 24 is depressed, as indicated by the arrow in FIG. 7. This depression overcomes the detent means 36–37 and causes the two drive teeth 31 to enter the recesses 39 of the inner cap section and by resuming the counterclockwise rotation of the outer cap section 22, the square shoulders 35 of the two drive teeth will engage and drive the square corners 41 of the recesses, thus causing both the inner and outer cap sections 23 and 22 to rotate counterclockwise in unison until the safety cap assembly is removed from the container.

Referring to FIGS. 9 through 11, when the safety cap is being re-applied and tightened on the container, the same relative position of parts will occur in FIG. 9 as existed in FIG. 8 during the final state of cap removal. Both cap sections 22 and 23 are now turned in unison clockwise as shown by the directional arrows, and as the process begins, both caps rotate freely and there is insufficient resistance to overcome the detent means 36–37 so that the push button operator 24 does not yet begin to rise although the surfaces 32 and 40 are in engagement. However, when the inner cap section 23 begins to tighten on the bottle neck 27, its resistance to rotation increases while the outer cap section 22 continues to rotate. This produces a positive camming action between the engaged surfaces 32 and 40 and overcomes the holding power of the detent means 36–37, whereby the push button operator 24, as shown in FIG. 10, begins to rise to its elevated safe or child-proof indicating position shown in FIG. 11 as well as in FIGS. 2 and 3.

When the push button operator 24 is fully elevated, FIG. 11, the outer cap section 22 continues to rotate clockwise and the spring pawls 43 now move into engagement with ratchet teeth 42 of the inner cap section 23 so as to drive the inner cap section to a completely tightened state on the container neck. During reverse rotation of the outer cap section 22, the spring pawls 43 simply ratchet over the teeth 42.

Preferably, the side wall portions of the push button operator 24 which project above the outer cap section when the operator is fully elevated are colored green to indicate to a viewer that the cap assembly is safe or child-proof. When the push button operator is depressed and the green surfaces are hidden, a viewer will know that the cap assembly is unsafe for children.

The detent means 36–37 is a simple two position detent or locator for the push button operator 24 to releasably lock it fully "up" as in FIG. 11 or fully depressed as in FIG. 9. During tightening of the cap assembly, the camming surfaces 32 and 40 can easily overcome the holding force of the detent means.

It should be pointed out that while the push button operator 24 is illustrated as a generally rectangular bar-like element, it could be made in oval-form or even circular with proper sizing.

The safety cap afforded by the invention is convenient and easy to use by adults without discomfort. It is quite effective in preventing young children from removing the cap assembly, and it is entirely practical and economical to manufacture.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A safety cap assembly for containers comprising connected relatively rotatable outer and inner cap sections, the inner cap section being internally screw-threaded for engagement with container screw-threads, a push button operator carried by the outer cap section including depending drive tooth means adapted for engagement with cooperating drive means on the inner cap section when said operator is depressed following rotation of the outer cap section to align said tooth means with said drive means, said tooth means and said drive means having engageable cam surfaces whereby relative rotation of the outer and inner cap sections in one direction causes said cam surfaces to elevate said push button operator to a safe indicating position, and cooperative engageable final tightening drive elements on the outer and inner cap sections positioned thereon to move into engagement following elevation of the push button operator by the coaction of said cam surfaces.

2. A safety cap assembly for containers as defined in claim 1, and two position detent means for said push button operator on the operator and on the outer cap section and adapted to be overcome by the coaction of said cam surfaces in elevating the push button operator.

3. A safety cap assembly for containers as defined in claim 1, and alignable indicator means on said outer and inner cap sections which move into alignment during rotation of the outer cap section relative to the inner cap section when the drive tooth means are in registration with said cooperating drive means on the inner cap section.

4. A safety cap assembly for containers as defined in claim 1, and said cooperating drive means on the inner cap section comprising recess means in the top face of the inner cap section adapted to receive the depending drive tooth means.

5. A safety cap assembly for containers as defined in claim 1, and said depending drive tooth means comprising a pair of diametrically spaced drive teeth on the push button operator each having a lower inclined surface portion defining a cam surface, and said drive means on the inner cap section comprising a pair of diametrically spaced recesses in the top of the inner cap section each having an inclined cam surface portion.

6. A safety cap assembly for containers as defined in claim 5, and each drive tooth and recess having square opposing abutment parts for the positive driving of the inner cap section in the direction to loosen the inner cap section during rotation of the outer cap section with said push button operator depressed, said abutment parts being away from said cam surface portions of said teeth and recesses.

7. A safety cap assembly for containers as defined in claim 1, and said final tightening drive elements comprising cooperative ratchet teeth and pawls on said inner and outer cap sections and being spaced circumferentially of the drive tooth means when the drive tooth means is engaged with said cooperating drive means.

8. A safety cap assembly for containers as defined in claim 1, and at least a retainer tab on said push button operator engageable with a part of the outer cap section to maintain the connection between the push button operator and the outer cap section.

9. A safety cap assembly for containers as defined in claim 1, and at least the side wall portions of the push button operator which project above the outer cap section when the operator is fully elevated having indicia to indicate the safe condition of said cap assembly.

10. A safety cap assembly for containers as defined in claim 1, and interengaging swivel connecting means on the inner and outer cap sections allowing relative rotation thereof while preventing relative axial displacement thereof.

* * * * *